United States Patent [19]

Freudenschuss et al.

[11] Patent Number: 4,490,098

[45] Date of Patent: Dec. 25, 1984

[54] FUEL-INJECTING PISTON PUMP FOR DIESEL ENGINES

[75] Inventors: Otto Freudenschuss; Josef Morell, both of Vienna; Leopold Rollenitz, Kirchstetten; Harald Schmidt, Vienna, all of Austria

[73] Assignee: Steyr-Daimler-Puch Aktiengesellschaft, Vienna, Austria

[21] Appl. No.: 487,508

[22] Filed: Apr. 22, 1983

[30] Foreign Application Priority Data

Apr. 27, 1982 [AT] Austria ..... 1628/82

[51] Int. Cl.[3] ..... F02M 59/26

[52] U.S. Cl. ..... 417/499

[58] Field of Search ..... 417/494, 499; 123/500, 123/501, 503

[56] References Cited

U.S. PATENT DOCUMENTS 1,958,948 5/1934 Knecht ..... 417/499

3,737,258 7/1968 Kravja et al. ..... 417/499

FOREIGN PATENT DOCUMENTS 395749 7/1933 United Kingdom ..... 123/503

*Primary Examiner*—Leonard E. Smith

*Attorney, Agent, or Firm*—Kurt Kelman

[57] ABSTRACT

A fuel-injecting pump for diesel engines comprises pump cylinders, which are associated with respective engine cylinders and enclose a pump piston, which is adapted to be driven by a camshaft. The pump cylinders are provided with at least one radial fuel port, which at its opening into the pump cylinder is adapted to be closed and opened by the pump piston, which has two axially spaced apart valve edges. The opening of the fuel port into the pump cylinder has in that region which during the discharge stroke of the pump is first reached by the opening valve edge a substantially larger radius of curvature in the peripheral direction than in the adjacent lateral regions. Said opening and the opening valve edge have a common tangent at that point of the opening which is reached last by the opening valve edge during the discharge stroke of the pump. In order to achieve a rapid pressure drop in the pump cylinder at the end of the fuel injection with simple means in spite of inaccuracies which are due to the manufacture, the opening of the fuel port into the pump cylinder has in that region which is first reached by the opening valve edge a radius of curvature in the peripheral direction which is twice to four times the radius of curvature of a circle having the same area.

1 Claim, 2 Drawing Figures

FUEL-INJECTING PISTON PUMP FOR DIESEL ENGINES

Figure 1:
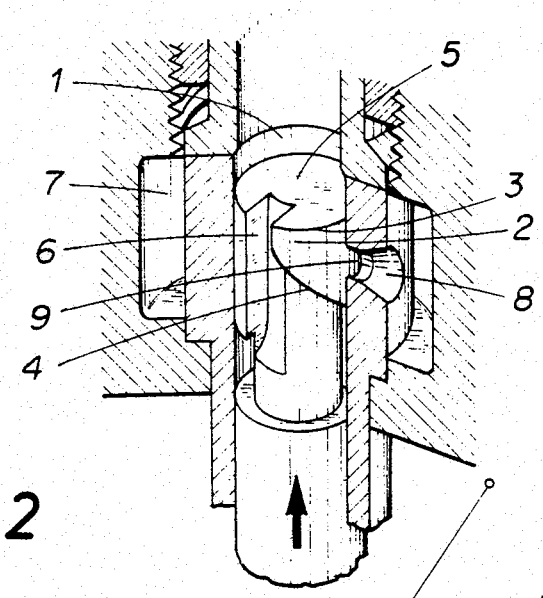

This invention relates to a fuel-injecting piston pump for diesel engines, which pump comprises pump cylinders which are associated with respective engine cylinders and enclose a pump piston that is adapted to be driven by a camshaft, which pump cylinders have at least one radial fuel port, which is adapted to be closed and opened by the pump piston, which has two axially spaced apart valve edges, wherein the opening of the fuel port into the pump cylinder has in that region which during the discharge stroke of the pump is first reached by the opening valve edge has a substantially larger radius of curvature in the peripheral direction than in the adjacent lateral regions and said opening and said opening valve edge have a common tangent at that point of said opening which is first reached by said opening valve edge during the discharge stroke of the pump.

In a known fuel-injecting piston pump the pump cylinder has a radial fuel port which serves to supply fuel and to drain the surplus fuel which is handled by the pump piston after the required quantity of fuel has been injected into the engine cylinder. For this purpose the pump piston has a central bore, which extends from the end face of the piston to an oblique incision which is formed in the pump piston and defines the opening valve edge. The rim of the end face of the pump piston constitutes the closing valve edge. As soon as said end face has moved past the opening of the fuel port during the discharge stroke of the pump piston, the fuel port is closed and the full discharge pressure is being built up because the opening valve edge has not yet reached the fuel port. Only after the pump piston has continued its stroke to an extent which depends on the rotational position of the pump piston will said opening valve edge reach the fuel port so that the surplus fuel then enclosed in the cylinder can be drained through the central piston bore and the oblique incision past the opening valve edge into the radial fuel port.

Other known fuel-injecting piston pumps have two diametrically opposite fuel ports and a pump piston which is formed in its peripheral surface with a longitudinal groove leading to a recess which defines the opening valve edge. In said pumps fuel will also be drained when one of the two radial fuel ports is exposed by said valve edge. On the other hand, fuel enters through both fuel ports at the beginning of the discharge stroke of the pump piston. In that arrangement the permissible angular adjustment which can be imparted to the pump piston in order to adjust the injected quantity determined by the opening valve edge is less than 180 degrees. In both known fuel-injecting piston pumps the opening of the radial fuel port into the pump cylinder is approximately circular and the draining of the fuel from the pump cylinder through the fuel port, which is relatively small in cross-section for strength reasons, is not permitted so quickly that the requirement for a combustion without a formation of pollutants is fully complied with. One of the requirements for a desirable combustion is a rapid pressure drop in the fuel-injecting conduit at the end of the fuel injection so that a supply of fuel under relatively low pressure into the combustion chamber will be avoided. Such fuel would not be adequately atomized so that the excessively large droplets of fuel would not be entirely burnt in the short time which is left after the combustion in the combustion chamber has substantially progressed and until the exhaust valve opens and that incomplete combustion results in an emission of solid particles and unburnt hydrocarbons in the exhaust gas. Whereas in pumps having two radial fuel ports which are diametrically opposite to each other the pump piston might be provided with two opening valves edges in order to ensure a more rapid pressure drop, that design would involve the disadvantage that the range of the angular adjustment of the pump piston for the quantity control would be restricted to less than 180 degrees. In some cases this may involve an adjusting mechanism which is delicate as regards manufacturing tolerances and wear so that an inaccurate adjustment of the quantity of fuel may result.

From British Patent Specification No. 442,554 it is known that a rapid pressure drop in the pump cylinder at the end of the fuel injection can be effected in such a manner that the quantity adjustment will not be restricted if the opening of the fuel port into the pump cylinder has in that region which during the discharge stroke of the pump is first reached by the opening valve edge a much larger radius of curvature than in the adjacent lateral regions and the helical opening valve edge and the opening of the fuel port have a common tangent at that point which is first reached by the valve during the discharge stroke of the pump. Owing to the substantially larger radius of curvature of the opening of the fuel port, the cross-sectional area in which the fuel port is initially exposed by the opening valve edge in a certain stroke position of the piston should be larger than in case of a fuel port which is circular in cross-section at its open so that the desired rapid pressure drop in the pump cylinder will be achieved. In the known design the opening of the fuel port into the pump cylinder has in a developed view generally the configuration of a triangle having rounded transitions between its dies so that an infinite radius of curvature in the peripheral direction is obtained in the region in question. Similar remarks are applicable to another known design (French Patent Specification No. 2,164,987), in which the opening of the fuel port into the pump cylinder consists of a slot, which extends in the direction of the valve edge. If in a developed view one side of the port opening having a triangular or elongate basic configuration is parallel to the associated valve edge, a disadvantage will result which resides in that angular deviations between one side of the triangular or slotlike port opening and the associated valve edge will considerably retard the desired pressure drop because in such case only a relatively small area of the port opening will be initially exposed. Such angular deviations which are due to the manufacturing technology cannot be avoided in practice.

For this reason it is an object of the invention to eliminate these disadvantages and so to improve the fuel-injecting piston pump described first hereinbefore that a fast pressure drop in the pump cylinder is achieved at the end of the fuel injection with simple means and in spite of the inevitable manufacturing tolerances.

This object is accomplished by the invention in that the radius of curvature of the opening of the fuel port into the cylinder has in that region which is first reached by the opening valve edge is twice to four times the radius of curvature of a circle having the same area.

Because the indicated portion of the opening is curved in accordance with the invention in accordance with an arc of a circle, the same sudden pressure drop will always be achieved in spite of the inevitable inaccuracies which are due to the manufacture. This is due to the fact that a chord defining an arc of a circle will always expose a segment of a circle in the same area regardless of the angular position of the chord. That design results in a desirable cross-sectional area and avoids excessively steeply rounded portions. Owing to the rapid pressure drop achieved in accordance with the invention it will generally be sufficient to provide a single radial fuel port so that the pump piston can be rotationally adjusted almost through an entire revolution and any quantity to be injected can be adjusted to a higher accuracy. The fuel port can be formed in any desired cross-sectional shape by electroerosion and it is sufficient to provide the configuration taught by the invention only at the opening into the pump cylinder.

Figure 2:
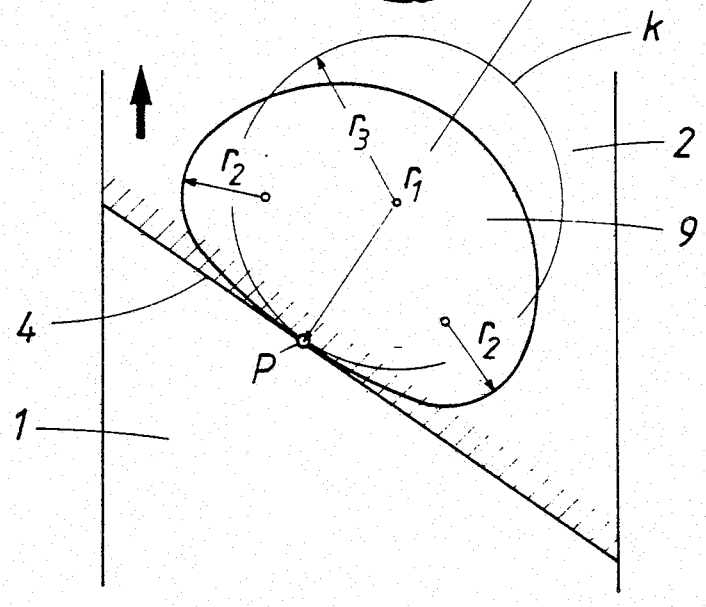

The subject matter of the invention is illustrated by way of example in the drawing, in which FIG. 1 is a perspective view showing partly in section the essential parts of a pump cylinder which is associated with an engine cylinder and FIG. 2 is a diagrammatic view showing the opening of the fuel port into the pump cylinder and the opening valve edge of the pump piston.

Fuel-injecting piston pumps for diesel engines comprise for each engine cylinder a pump cylinder 1, which encloses a pump piston 2, which is adapted to be driven by a camshaft, not shown. The pump piston 2 has two axially spaced apart valve edges 3, 4. The valve edge 3 is formed by the edge of the end face 5 of the piston. The valve edge 4 extends along a helix. The space below the valve edge 4 communicates with the working chamber proper above the end face 5 of the piston through a longitudinal groove 6. The wall of the pump cylinder 1 is surrounded by an annular passage 7, which is connected to the fuel supply line and from which a radial fuel port 8 leads into the pump cylinder 1. The opening of the fuel port 8 into the pump cylinder 1 is designated 9.

When the end face 5 of the piston is disposed below the opening 9 of the fuel port 8, fuel will be entering the pump cylinder until the valve edge 3 has moved across the opening 9 during the upwardly directed discharge stroke of the pump piston 2 so that the pump cylinder 1 is then closed. During the continued upward movement of the pump piston, a corresponding pressure is built up, which finally results in an injection of fuel into the engine cylinder, not shown. As soon as the valve edge 4 has exposed the opening 9 of the fuel port 8, the surplus fuel which is still enclosed in the pump cylinder 1 is permitted to drain. The fuel port 8 serves for the supply of fuel and for the draining of fuel when the discharge stroke has been terminated. The piston 2 is rotatable so that the displacement of the piston between the closing of the port opening 9 and the exposure of said opening can be changed in dependence on the rotational position and the quantity which is injected into the engine cylinder can thus be controlled.

As is apparent from FIG. 2, the opening of the fuel port 8 into the cylinder 9 is not circular but in the region which during the discharge stroke of the pump indicated by an arrow, is first reached by the opening valve edge 4 has a substantially larger radius of curvature $r_1$ than in the adjacent lateral regions, which have the radius of curvature $r_2$. The radius of curvature $r_1$ is twice to four times the radius $r_3$ of a circle k having the same radius. The tangent to the opening 9 at that point P which during the discharge stroke of the pump is first reached by the valve edge 4 suitably coincides with the tangent to the valve edge 4 at that point P. Owing to this configuration of the opening 9 of the fuel port 8 into the pump cylinder 1, a substantially larger cross-sectional area of the fuel port is initially exposed than would be possible in case of a port bore which is circular in cross-section.

It may be desirable to design the opening 9 of the fuel port 8 into the pump cylinder 1 with such configuration that the radius of curvature in that region which is last reached by the valve edge 3 of the pump piston 2 is also substantially larger than in the adjacent lateral regions.

We claim:

1. A fuel-injecting piston pump for diesel engines, which pump comprises pump cylinders which are associated with respective engine cylinders and enclose a pump piston that is adapted to be driven by a camshaft, which pump cylinders have at least one radial fuel port, which is adapted to be closed and opened by the pump piston, which has two axially spaced apart valve edges, wherein the opening of the fuel port into the pump cylinder has in that region which during the discharge stroke of the pump is first reached by the opening valve edge has a substantially larger radius of curvature in the peripheral direction than in the adjacent lateral regions and said opening and said opening valve edge have a common tangent at that point of said opening which is first reached by said opening valve edge during the discharge stroke of the pump, characterized in that the opening (9) of the fuel port (8) into the pump cylinder (1) has in that region which is first reached by the opening valve edge (4) a radius of curvature ($r_1$) in the peripheral direction which is twice to four times the radius of curvature of a circle (k) having the same area.

* * * * *